US008328321B2

(12) United States Patent
Tsuzawa

(10) Patent No.: US 8,328,321 B2
(45) Date of Patent: Dec. 11, 2012

(54) IMAGE RECORDING APPARATUS

(75) Inventor: Yoshiyuki Tsuzawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 191 days.

(21) Appl. No.: 12/888,808

(22) Filed: Sep. 23, 2010

(65) Prior Publication Data

US 2011/0069104 A1 Mar. 24, 2011

(30) Foreign Application Priority Data

Sep. 24, 2009 (JP) ..... 2009-219381

(51) Int. Cl.
*B41J 29/377* (2006.01)
*B41J 2/01* (2006.01)

(52) U.S. Cl. ..... 347/18; 347/101; 347/102

(58) Field of Classification Search ..... None
See application file for complete search history.

(56) References Cited

U.S. PATENT DOCUMENTS

| | | | | |
|---|---|---|---|---|
| 5,500,658 | A | 3/1996 | Hattori et al. | |
| 2006/0221166 | A1* | 10/2006 | Inoue | 347/104 |
| 2007/0172285 | A1 | 7/2007 | Izawa et al. | |
| 2009/0295894 | A1* | 12/2009 | Hori | 347/102 |

FOREIGN PATENT DOCUMENTS

| | | | |
|---|---|---|---|
| JP | 1-157860 | A | 6/1989 |
| JP | 2007-196513 | A | 8/2007 |

* cited by examiner

*Primary Examiner* — Geoffrey Mruk

(74) *Attorney, Agent, or Firm* — Birch, Stewart, Kolasch & Birch, LLP

(57) ABSTRACT

An image recording apparatus includes: an image recording drum that suctions and holds a paper on an outer circumferential surface thereof in state of an image recording surface of the paper facing outward, and rotates at a constant speed so as to convey the paper; an image recording drum temperature adjustment device which adjusts temperature of the image recording drum; a cooling device which spouts out cooling air from a constant position towards the outer circumferential surface of the image recording drum in such a manner that the cooling air is blown onto the image recording surface of the paper conveyed by the image recording drum so as to cool the paper; and an image recording device which deposits ink onto the image recording surface of the paper conveyed by the image recording drum to record an image on the image recording surface, the image recording device being situated in a stage after the cooling device and depositing the ink onto the paper having been cooled to record the image.

14 Claims, 5 Drawing Sheets

IMAGE RECORDING APPARATUS

BACKGROUND OF THE INVENTION

1. Field of the Invention

The present invention relates to an image recording apparatus, and more particularly to an image recording apparatus that records an image with an ink jet system.

2. Description of the Related Art

In order to record high-resolution images with an ink jet system, the flight angle of droplets jetted out from a nozzle should be stabilized. In order to stabilize the flight angle of the droplets jetted out from a nozzle, it is necessary to maintain the ink temperature equal to or lower than a predetermined temperature, maintain a high-viscosity state of the ink, and stabilize the meniscus. For this purpose the head temperature should be adjusted and maintained equal to or lower than a predetermined temperature.

However, a problem arising when the head is controlled to a temperature equal to or lower than a predetermined temperature is that dew condensation occurs in the head and this dew condensation causes recording defects.

Japanese Patent Application Publication No. 1-157860 suggests providing a dew condensation member or a moister-absorbing member in the vicinity of the head as a technique for preventing such dew condensation in the head.

Japanese Patent Application Publication No. 2007-196513 discloses a technique where, in a case where printing is conducted on both surfaces of continuous paper, after printing is performed on the front surface side and thermal drying is conducted, the paper is passed through a cooling roller unit and cooled, the paper is then turned over, and printing is performed on the rear surface side, thereby preventing dew condensation in the head performing printing on the rear surface.

However, according to the method disclosed in Japanese Patent Application Publication No. 1-157860, the dew condensation member or the like should be periodically replaced, time and efforts are required for maintenance, and running cost is increased. Further, performance is not stable due to the deterioration of the dew condensation member and the like.

According to the method disclosed in Japanese Patent Application Publication No. 2007-196513, paper is passed through a cooling roller unit and therefore the paper conveying path is accordingly extended and the apparatus is increased in size. Further, the paper is brought into contact with the cooling roller to be cooled, and therefore if the paper conveying speed is increased, the contact time cannot be ensured and the paper cannot be sufficiently cooled. Moreover, if the paper conveying speed is reduced to resolve such a problem, then the printing processing speed decreases.

SUMMARY OF THE INVENTION

With the foregoing in view, it is an object of the present invention to provide an image recording apparatus that can prevent dew condensation onto equipment and enable the recording of high-quality images.

In order to attain an object described above, one aspect of the present invention is directed to an image recording apparatus comprising: an image recording drum that suctions and holds a paper on an outer circumferential surface thereof in state of an image recording surface of the paper facing outward, and rotates at a constant speed so as to convey the paper; an image recording drum temperature adjustment device which adjusts temperature of the image recording drum; a cooling device which spouts out cooling air from a constant position towards the outer circumferential surface of the image recording drum in such a manner that the cooling air is blown onto the image recording surface of the paper conveyed by the image recording drum so as to cool the paper; and an image recording device which deposits ink onto the image recording surface of the paper conveyed by the image recording drum to record an image on the image recording surface, the image recording device being situated in a stage after the cooling device and depositing the ink onto the paper having been cooled to record the image.

According to this aspect of the invention, the paper is cooled with the cooling device immediately before an image is recorded thereon with the image recording device. By so cooling the paper immediately prior to image recording, it is possible to induce dew condensation occurring in the vicinity of the image recording device on the paper side and prevent dew condensation on equipment. Thus, dew condensation occurs when moisture contained in the atmosphere exceeds the absolute moisture amount, and occurs on a member with a low surface temperature that is in contact with the atmosphere. Therefore, by cooling the paper immediately before an image is recorded thereon with the image recording device, it is possible to induce dew condensation on the paper side. As a result, dew condensation on the equipment can be prevented. Further, according to this aspect of the invention, the paper is cooled while being brought into intimate contact with the outer circumferential surface of the temperature-adjusted image recording drum, and is also cooled by directly blowing cooling air onto the image recording surface. Therefore, the paper can be sufficiently cooled over a short period of time. The paper can be cooled to a certain degree by bringing the paper into contact with the temperature-adjusted image recording drum, but because the paper itself has thermal insulating properties, the paper is difficult to be cooled up to the surface (image recording surface) over a short period of time. In particular, thick paper is especially difficult to be cooled up to the surface over a short period of time. However, according to this aspect of the invention, the cooling air is brought into direct contact with the image recording surface of the paper, and therefore the paper can be cooled immediately even if the paper is thick. As a result, the paper can be sufficiently cooled over a short period of time, without decreasing the conveying speed or extending the conveying path.

Desirably, the image recording apparatus further comprises a treatment liquid application unit that deposits a predetermined treatment liquid onto the image recording surface of the paper and dries the treatment liquid deposited onto the image recording surface, wherein the paper which the treatment liquid is deposited onto and is dried by the treatment liquid application unit is fed to the image recording drum.

According to this aspect of the invention, the paper is fed to the image recording drum after the treatment liquid has been applied thereto and drying has been performed in the treatment liquid application unit. The paper subjected to the treatment liquid application and drying has been heated during drying and the temperature thereof rises. Therefore, where the paper is directly fed to image recording, dew condensation is induced on equipment with a low temperature. However, according to this aspect of the invention, since the paper is cooled immediately prior to image recording, dew condensation is induced on the paper side and dew condensation on the equipment can be effectively prevented.

Desirably, the treatment liquid application unit includes: a treatment liquid application drum that holds the paper on the outer circumferential surface thereof in state of the image recording surface of the paper facing outward, and rotates at a constant speed so as to convey the paper; a transfer drum that is disposed between the treatment liquid application drum and the image recording drum, receives the paper from the treatment liquid application drum, rotates at a constant speed so as to convey the paper, and transfers the paper to the image recording drum in a predetermined transfer position; a treatment liquid application device which deposits the treatment liquid onto the image recording surface of the paper conveyed by the treatment liquid application drum; and a drying device which heats the paper to which the treatment liquid has been applied by the treatment liquid application device, so as to dry the treatment liquid, a paper pressure roller formed according to width of the image recording drum is installed in close to a position where the paper is transferred from the transfer drum to the image recording drum, while being in contact with the outer circumferential surface of the image recording drum in such a manner that the paper pressure roller presses the paper transferred from the transfer drum against the outer circumferential surface of the image recording drum so as to bring the paper into intimate contact with the outer circumferential surface, and the cooling device spouts out the cooling air toward between the position where the paper is transferred from the transfer drum to the image recording drum and a position where the paper pressure roller is installed.

According to this aspect of the invention, the paper is fed to the image recording drum via the transfer drum. The paper fed to the image recording drum is pressed against the outer circumferential surface of the image recording drum by the pressure roller provided in the vicinity of the paper transfer position and brought into intimate contact with the outer circumferential surface of the image recording drum. The cooling air is spouted out by the cooling device between the position in which the pressure roller is installed and the position in which the paper is received. By so spouting the cooling air out between the position in which the pressure roller is installed and the position in which the paper is received, it is possible to obtain a structure in which cooling air leak is prevented and the paper can be cooled efficiently.

Desirably, the image recording apparatus further comprises a temperature adjustment device which adjusts temperature of the image recording device.

According to this aspect of the invention, the image recording device is provided with a temperature adjustment function and the temperature thereof can be adjusted. Thus, even when the image recording device has the temperature adjustment function and the image recording device is controlled by the temperature adjustment function to a temperature equal to or lower than the predetermined temperature, dew condensation can be induced on the paper, and therefore dew condensation on the equipment can be prevented.

Desirably, the cooling device spouts out the cooling air in form of a jet.

According to this aspect of the invention, the cooling air is spouted out in the form of a jet having increased velocity. Therefore, the paper can be cooled with better efficiency.

Desirably, the cooling device spouts out the dehumidified cooling air.

According to this aspect of the invention, the dehumidified cooling air is spouted out. As a result, the occurrence of dew condensation can be effectively prevented.

Desirably, the image recording apparatus further comprises an adjustment device which adjusts temperature and/or an amount of the cooling air spouted out by the cooling device.

According to this aspect of the invention, the temperature and/or amount (velocity) of cooling air spouted out by the cooling device is adjusted with the adjusting device. For example, the operator sets a target temperature for the image recording drum, and conducts the adjustment of maximizing the air amount when the temperature of the image recording drum exceeds the target temperature and minimizing the air amount when the temperature of the image recording drum is equal to or lower than the target temperature. Alternatively, the adjustment is performed such that the temperature is set to the minimum temperature (minimum value of temperature that can be set) when the temperature of the image recording drum exceeds the target temperature and the temperature is made equal to the temperature of the image recording drum when the temperature of the image recording drum is equal to or lower than the target temperature. Alternatively, the adjustment is performed such that the air amount is maximized and the temperature is minimized when the temperature of the image recording drum exceeds the target temperature and such that the air amount is minimized and the temperature is made equal to the temperature of the image recording drum when the temperature of the image recording drum is equal to or lower than the target temperature.

Desirably, the image recording apparatus further comprises a control device which controls temperature and/or an amount of the cooling air spouted out by the cooling device according to the temperature of the image recording drum.

According to this aspect of the invention, the temperature and/or amount (air velocity) of the cooling air spouted out by the cooling device is controlled according to the temperature of the image recording drum. For example, a target temperature is set for the image recording drum and control is conducted such that the air amount is maximized when the temperature of the image recording drum exceeds the target temperature and the air amount is minimized when the temperature of the image recording drum is equal to or lower than the target temperature. Alternatively, the control is performed such that the temperature is minimized (minimum value of temperature that can be set) when the temperature of the image recording drum exceeds the target temperature and such that the temperature is made equal to the temperature of the image recording drum when the temperature of the image recording drum is equal to or lower than the target temperature. Alternatively, control is performed such that the air amount is maximized and the temperature is minimized when the temperature of the image recording drum exceeds the target temperature and such that the air amount is minimized and the temperature is made equal to the temperature of the image recording drum when the temperature of the image recording drum is equal to or lower than the target temperature.

Desirably, the image recording apparatus further comprises a control device which controls temperature and/or an amount of the cooling air spouted out by the cooling device according to thickness and/or size of the paper.

According to this aspect of the invention, the temperature and/or amount of cooling air spouted out by the cooling device is controlled according to the thickness and/or size of the paper. As a result, the cooling air of adequate temperature and amount can be blown according to the paper type.

Desirably, the image recording apparatus further comprises a drive control device which switches ON/OFF driving of the cooling device, wherein when the image recording drum temperature adjustment device heats the image recording drum, the drive control device switches OFF the driving of the cooling device, and when the image recording drum temperature adjustment device cools the image recording drum, the drive control device switches ON the driving of the cooling device.

According to this aspect of the invention, the driving of the cooling device is switched OFF when the image recording drum temperature adjustment device heats the image recording drum, and the driving of the cooling device is switched ON when the image recording drum temperature adjustment device cools the image recording drum. As a result, unnecessary cooling can be prevented and the apparatus can be efficiently operated.

Desirably, the cooling device has an ionizer.

According to this aspect of the invention, the cooling device is provided with an ionizer and the spouted-out cooling flow has ionized molecules in the air. As a result, static electricity of the paper can be removed, the paper can be prevented from sticking to the image recording drum under the effect of static electricity, and variations in the ink flight caused by static electricity can be prevented.

Desirably, the image recording drum temperature adjustment device spouts out a temperature adjusting air towards the outer circumferential surface of the image recording drum, from a position where the paper conveyed by the image recording drum does not pass, in such a manner that the temperature adjusting air is blown onto the outer circumferential surface of the image recording drum so as to adjust the temperature of the image recording drum.

According to this aspect of the invention, the temperature of the image recording drum is adjusted by blowing the temperature adjusting air onto the outer circumferential surface of the image recording drum in a position where the paper does not pass.

Desirably, the image recording device employs an ink jet system to record the image on the paper.

According to this aspect of the invention, an image is recorded on the paper by an ink jet system.

In accordance with the present invention, dew condensation on the equipment can be prevented and high-quality images can be recorded without decreasing the processing speed.

DETAILED DESCRIPTION OF THE PREFERRED EMBODIMENTS

Preferred embodiments of an image recording apparatus in accordance with an embodiment of the present invention will be explained below with reference to the appended drawings.

The case in which the present invention is applied to an ink jet recording apparatus will be explained by way of example.

First, the entire configuration of an ink jet recording apparatus to which the present invention is applied will be explained in a general way.

Entire Configuration of Ink Jet Recording Apparatus

Figure 1:
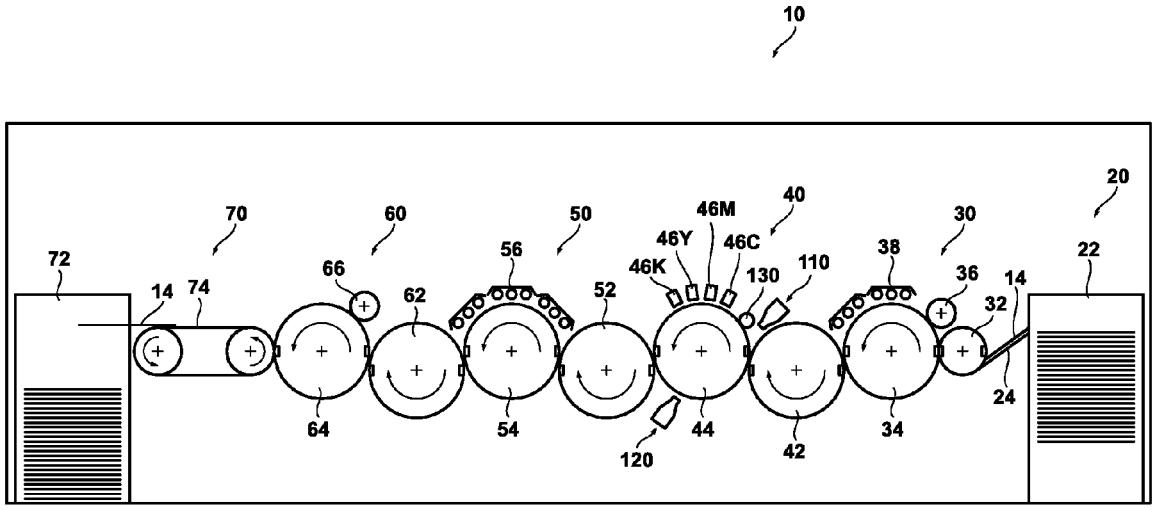
FIG. 1 illustrates the entire configuration of an ink jet recording apparatus.

FIG. 1 shows the entire configuration of an ink jet recording apparatus that records an image on a paper sheet with an ink jet system.

The ink jet recording apparatus 10 comprises a paper feed unit 20 that feeds paper (paper sheets) 14, a treatment liquid application unit 30 that applies a predetermined treatment liquid to an image recording surface of the paper 14, an image recording unit 40 that records an image by jetting out ink droplets from an ink jet head onto the image recording surface of the paper 14, a drying unit 50 that dries the ink that has landed on the paper 14, a fixing unit 60 that fixes the image recorded on the paper 14, and a paper discharge unit 70 that discharges the paper after image recording. The operation of the entire apparatus is controller by a controller 80.

Conveying drums 34, 44, 54, and 64 serving as conveying means are provided in the treatment liquid application unit 30, image recording unit 40, drying unit 50, and fixing unit 60, respectively. The paper 14 is wound around the circumferential surface of the conveying drums 34, 44, 54, and 64 and conveyed while the treatment liquid application unit 30, image recording unit 40, drying unit 50, and fixing unit 60 are being rotated.

Transfer drums 32, 42, 52, and 62 are disposed as conveying means between the paper feed unit 20 and the treatment liquid application unit 30, between the treatment liquid application unit 30 and the image recording unit 40, between the image recording unit 40 and the drying unit 50, and between the drying unit 50 and the fixing unit 60, respectively. The paper 14 is wound around the circumferential surface of the transfer drums 32, 42, 52, and 62 and conveyed while the units are being rotated.

The conveying drums 34, 44, 54, and 64 and the transfer drums 32, 42, 52, and 62 are disposed alternately, driven by respective motors (not shown in the figure), and rotated in the mutually opposite directions. Thus, the conveying drums 34, 44, 54, and 64 rotate in the counterclockwise direction as shown in FIG. 1, and the transfer drums 32, 42, 52, and 62 rotate in the clockwise direction as shown in FIG. 1.

Grippers for gripping the distal end of the paper 14 are provided at the circumferential surface of the conveying drums 34, 44, 54, and 64 and the transfer drums 32, 42, 52, and 62. The distal end portion of the paper 14 is gripped by the grippers and the paper is wound around the circumferential surface of the conveying drums 34, 44, 54, and 64 and the transfer drums 32, 42, 52, and 62.

The paper 14 is wound around the circumferential surfaces of the conveying drums 34, 44, 54, and 64 so that the image recording surface is on the outside, and is wound around the circumferential surfaces of the transfer drums 32, 42, 52, and 62 so that a rear surface (surface on the side opposite that of the image recording surface) is on the outside.

The paper 14 fed from the paper feed unit 20 is transferred via the transfer drum 32 to the conveying drum 34 of the treatment liquid application unit 30, and transferred from the conveying drum 34 of the treatment liquid application unit 30 via the transfer drum 42 to the conveying drum 44 of the image recording unit 40. Then, the paper is transferred from the conveying drum 44 of the image recording unit 40 via the transfer drum 52 to the conveying drum 54 of the drying unit 50 and then transferred from the conveying drum 54 of the drying unit 50 via the transfer drum 62 to the conveying drum 64 of the fixing unit 60. Then, the paper is transferred from the conveying drum 64 of the fixing unit 60 to the paper discharge unit 70. In this sequential conveying process, the paper 14 passes through the treatment liquid application unit 30, image recording unit 40, drying unit 50, and fixing unit 60 and is subject to required processing in each unit, whereby an image is formed on the image recording surface.

The configuration of each component (paper feed unit 20, treatment liquid application unit 30, image recording unit 40, drying unit 50, fixing unit 60, and paper discharge unit 70) in jet recording apparatus 10 of the present embodiment will be described below in greater detail.

Paper Feed Unit

The paper feed unit 20 is provided with a paper feed device 22 and a paper feed tray 24, and continuously feeds the paper 14 sheet by sheet. The paper 14 is, for example, coated paper for printing (for example, thickness 0.06-0.34 mm (basis weight 100 to 300 gsm), maximum size 750 mm×53 mm, feed).

The paper feed device 22 feeds, sheet by sheet, the paper 14 that is accommodated in a stacked state in a stacker (not shown in the figure) sequentially from the upper side of the stack to the paper feed tray 24.

The paper feed tray 24 feeds out the sheets of paper 14 that have been sequentially fed sheet by sheet from the paper feed device 22 to the transfer drum 32.

The paper 14 fed out from the paper feed tray 24 is transferred via the transfer drum 32 to the conveying drum 34 of the treatment liquid application unit 30.

Treatment Liquid Application Unit

The treatment liquid application unit 30 performs a process of applying a predetermined treatment liquid to the image recording surface of the paper 14 and drying the applied treatment liquid.

The treatment liquid application unit 30 comprises the conveying drum (treatment liquid application drum) 34 that conveys the paper 14, a treatment liquid application device 36 that applies the predetermined treatment liquid to the image recording surface of the paper 14 that is conveyed by the treatment liquid application drum 34, and a treatment liquid drying device 38 that heats and dries the paper 14 to which the treatment liquid has been applied.

The treatment liquid application drum 34 receives the paper 14 from the transfer drum 32 (grips the distal end of the paper 14 with the gripper), winds the received paper 14 around the outer circumferential surface, and rotates at a constant speed to convey the paper 14 at a constant speed along a predetermined conveying path (conveying path in the form of circular arc along the outer circumferential surface of the treatment liquid application drum 34). In this case, the paper 14 is conveyed so that the image recording surface thereof faces outward.

The treatment liquid application device 36 applies the predetermined treatment liquid to the image recording surface of the paper 14 that is conveyed by the treatment liquid application drum 34. The treatment liquid application device 36 presses a coating roller having the treatment liquid applied to the circumferential surface thereof, against the circumferential surface of the paper 14, and gives (applies) the treatment liquid with a predetermined thickness to the image recording surface of the paper 14.

The treatment liquid that is applied to the paper 14 by the treatment liquid application device 36 has a function of reacting with the ink applied to the paper 14 in the image recording unit 40 of the subsequent stage and causing cohesion (aggregation) of a colorant contained in the ink. When such a treatment liquid is applied in advance and ink droplets are then jetted out on the paper 14, the colorant contained in the jetted ink coheres immediately after landing. As a result, the colorants in the adjacently landed ink droplets are prevented from mixing.

In the present example, a configuration is considered in which the treatment liquid is applied with a coating roller, but this is not limited to the above-described configuration. For example, the treatment liquid may be also jetted out and deposited with an ink jet head or the treatment liquid may be deposited by spraying.

The treatment liquid drying device 38 heats and dries the paper 14 after the treatment liquid has been applied thereto. The treatment liquid drying device 38 is constituted by a plurality of heaters (for example, infrared heaters) disposed opposite the outer circumferential surface of the treatment liquid application drum 34, and radiates heat towards the treatment liquid application drum 34 so that the paper 14 conveyed by the treatment liquid application drum 34 can be heated and dried. The paper 14 having the treatment liquid applied thereto by the treatment liquid application device 36 passes through the treatment liquid drying device 38, and thereby the paper is heated and a solvent component (liquid component) thereof is evaporated and dried. As a result, a treatment agent layer in the solid or semisolid form is formed on the image recording surface of the paper 14.

In the configuration of the present example, the paper 14 is heated and dried with a heater, but such a configuration for heating and drying the paper 14 is not limiting. For example, the paper 14 can be heated and dried by blowing hot air thereonto with a hot-air fan. Further, the treatment liquid drying device 38 can be also constituted by a combination of a heater and a hot-air fan.

The treatment liquid application unit 30 has the above-described configuration. The paper 14 transferred from the transfer drum 32 to the treatment liquid application drum 34 is conveyed by the treatment liquid application drum 34 at a constant speed along a predetermined conveying path. In this conveying path, first, the treatment liquid is applied to the image recording surface by the treatment liquid application device 36. The paper 14 coated with the treatment liquid by the treatment liquid application device 36 is then heated by the treatment liquid drying device 38. As a result, the solvent component of the treatment liquid that has adhered to the image recording surface is evaporated and dried. The paper 14 is then transferred to the transfer drum 42, conveyed by the transfer drum 42 along a predetermined conveying path, and transferred to the conveying drum 44 of the image recording unit 40.

Image Recording Unit

In the image recording unit 40, ink droplets of C, M, Y, and K colors are jetted out onto the image recording surface of the paper 14 and a color image is formed on the image recording surface of the paper 14. The image recording unit 40 is constituted by the conveying drum (image recording drum) 44 that conveys the paper 14, ink jet heads 46C, 46M, 46Y, and 46K that jet out ink droplets of C, M, Y, and K colors onto the paper 14, a cooling device 110 that cools the paper 14 before an image is recorded, an image recording drum temperature adjustment device 120 that adjusts the temperature of the image recording drum 44, and a pressure roller 130 that presses the paper 14 transferred from the transfer drum 42 to the image recording drum 44 against the outer circumferential surface of the image recording drum 44 and brings the paper into intimate contact with the outer circumferential surface of the image recording drum 44.

The image recording drum 44 receives the paper 14 from the transfer drum 42 and the received paper is wound around the circumferential surface of the image recording drum 42, suctioned thereto, held thereon, and rotated at a constant speed, whereby the paper 14 is conveyed along a predetermined conveying path.

The image recording drum 44 receives the paper 14 from the transfer drum 42 (the distal end of the paper 14 is gripped by the gripper), winds the received paper 14 around the circumferential surface of the image recording drum 44, suctions and holds the received paper 14, and rotates at a constant speed. As a result, the paper 14 is conveyed at a constant speed along a predetermined conveying path (a circular-arc conveying path along the outer circumferential surface of the image recording drum 44). In this case, the paper 14 is conveyed so that the image recording surface faces outward. A specific configuration of the image recording drum 44 will be described below.

A total of four ink jet heads 46C, 46M, 46Y, and 46K are disposed with a constant spacing above the outer circumference of the image recording drum 44, and eject ink droplets of respectively corresponding colors towards the image recording drum 44. These ink jet heads 46C, 46M, 46Y, and 46K are constituted by line heads corresponding to the paper width. A nozzle row of a length corresponding to the paper width is formed in the direction perpendicular to the conveying direction of the paper 14 on the surface (nozzle surface) facing the image recording drum 44.

These ink jet heads 46C, 46M, 46Y, and 46K are provided with a temperature adjustment function (temperature adjustment means) and controlled to a constant temperature. In the present embodiment, the heads are controlled to a low temperature equal to or lower than a predetermined temperature to maintain a high-viscosity state of the ink. As a result, the meniscus can be stabilized and the flight angle of the droplets can be also stabilized.

Further, the temperature adjustment of the ink jet heads 46C, 46M, 46Y, and 46K can be also realized, for example, by incorporating a Peltier element or the like into each head.

The cooling device 110 blows cooling air onto the image recording surface of the paper 14 that has been transferred from the transfer drum 42 to the image recording drum 44 and cools the paper 14. The configuration of the cooling device 110 will be described below in greater detail.

The image recording drum temperature adjustment device 120 adjusts the temperature of the image recording drum 44 by blowing air conditioned flow (temperature adjusted flow) onto the outer circumferential surface of the image recording drum 44. The configuration of the image recording drum temperature adjustment device 120 will be described below in greater detail.

The pressure roller 130 is formed according to the paper width, pressed against the outer circumferential surface of the image recording drum 44, and brought into intimate contact therewith. The pressure roller 130 is provided close to the transfer position in which the transfer drum 42 transfers the paper 14 to the image recording drum 44. The pressure roller 130 applies a pressure to the image recording surface of the paper 14 transferred to the image recording drum 44, thereby pressing the paper against the outer circumferential surface of the image recording drum 44 and bringing the paper into intimate contact with the surface.

The cooling device 110 spouts out cooling air between the installation position of the pressure roller 130 and the transfer position of the paper 14, thereby cooling the paper 14. This feature will be described below in greater detail.

The image recording unit 40 is configured as described hereinabove. The paper 14 transferred from the transfer drum 42 to the image recording drum 44 is conveyed at a constant speed along a predetermined conveying path by the image recording drum 44. In this conveying path, first, the cooling air spouted out from the cooling device 110 falls on the image recording surface and cools the surface. Then, the paper 14 is pressed by the pressure roller 130 against the image recording drum 44 and brought into intimate contact with the outer circumferential surface of the image recording drum 44. Then, inks of C, M, Y, and K colors are jetted out from the ink jet heads 46C, 46M, 46Y, and 46K onto the image recording surface, and a color image is recorded on the image recording surface. The paper 14 on which the image has been recorded is transferred from the image recording drum 44 to the transfer drum 52, conveyed by the transfer drum 52 along a predetermined conveying path, and transferred to the conveying drum 54 of the drying unit 50.

In the present example, aqueous inks in which a thermoplastic resin is dispersed in ink are used as the inks jetted out from the ink jet heads 46C, 46M, 46Y, and 46K.

Drying Unit

The drying unit 50 dries the paper 14 on which the image has been recorded. The drying unit 50 includes a conveying drum (drying drum) 54 that conveys the paper 14 and a drying device 56 that heats and dries the paper 14 conveyed by the drying drum 54.

The drying drum 54 receives the paper 14 from the transfer drum 52 (receives the paper by gripping the distal end of the paper 14 with the gripper), winds the received paper 14 around the outer circumferential surface and rotates at a constant speed in such a manner that the paper 14 is conveyed at a constant speed along a predetermined conveying path (arc-circular conveying path along the outer circumferential surface of the drying drum 54). In this case, the paper 14 is conveyed so that the image recording surface faces outward.

The drying device 56 heats and dries the paper 14 after image recording. The drying device 56 is constituted by a plurality of heaters (for example, infrared heaters) disposed opposite to the outer circumferential surface of the drying drum 54, and radiates heat towards the drying drum 54 in such a manner that the paper 14 conveyed by the drying drum 54 is heated and dried. The paper 14 in which the ink has been applied to the image recording surface with the image recording unit 40 is heated when passing through the drying device 56, and the solvent component (liquid component) thereof is evaporated and the paper 14 is dried.

The drying unit 50 has the above-described configuration. The paper 14 transferred from the image recording drum 44 to the drying drum 54 via the transfer drum 52 is conveyed by the drying drum 54 along a predetermined conveying path. In this conveying path, the paper is heated by the drying device 56. As a result, the solvent component contained in the ink applied to the image recording surface is evaporated and the paper 14 is dried. After the drying, the paper 14 is transferred from the drying drum 54 to the transfer drum 62, conveyed by the transfer drum 62 along a predetermined conveying path, and transferred to the conveying drum 64 of the fixing unit 60.

Fixing Unit

The fixing unit 60 heats and pressurizes the paper 14 and fixes the image recorded on the image recording surface. The fixing unit 60 includes the conveying drum (fixing drum) 64 that conveys the paper 14 and a heat roller 66 that conducts a heating and pressurization treatment of the paper 14 conveyed by the fixing drum 64.

The fixing drum 64 receives the paper 14 from the transfer drum 62 (receives the paper by gripping the distal end of the paper 14 with the gripper), winds the received paper 14 about the outer circumferential surface and rotates at a constant speed in such a manner that the paper 14 is conveyed along a predetermined conveying path (circular-arc conveying path along the outer circumferential surface of the fixing drum 64). In this case, the paper 14 is conveyed while the image recording surface faces outward.

The heat roller 66 heats and pressurizes the inks dried in the drying unit 50 in such a manner that the thermoplastic resin dispersed in the ink is fused and thereby the inks form a film. At the same time, cockles that have originated in the paper 14 are corrected. The heat roller 66 is formed according to the paper width and heated to a predetermined temperature by a heat source (for example, an infrared heater incorporated therein). Further, the paper is pressed against the circumferential surface of the fixing drum 64 and brought into contact therewith by a predetermined pressure force with a pressurization device (not shown in the figure).

The fixing unit 60 is configured as described hereinabove. The paper 14 transferred from the transfer drum 62 to the fixing drum 64 is conveyed along a predetermined conveying path by the fixing drum 64. In the conveying path, the heat roller 66 is brought into contact with and pressed against the image recording surface and the image recording surface is heated and pressurized. As a result, the thermoplastic resin dispersed in the ink is fused and the ink forms a film. At the same time, cockles that have originated in the paper 14 are corrected. The paper 14 heated and pressurized by the heat roller 66 is transferred from the fixing drum 64 to the discharge unit 70.

Paper Discharge Unit

The paper discharge unit 70 recovers the paper 14 subjected to a sequence of image recording operations, to stacker 72. The paper discharge unit 70 includes a conveyor 74 that conveys the paper 14 to the stacker 72. The paper 14 subjected to fixing processing in the fixing unit 60 is transferred from the fixing drum 64 to the conveyor 74 and conveyed by the conveyor 74 to the installation position of the stacker 72. The stacker 72 is set to a predetermined recovery position, and the paper 14 conveyed by the conveyor 74 is discharged into the stacker 72. The paper 14 discharged into the stacker 72 is recovered by sequential stacking in the stacker 72.

Control System

Figure 2:
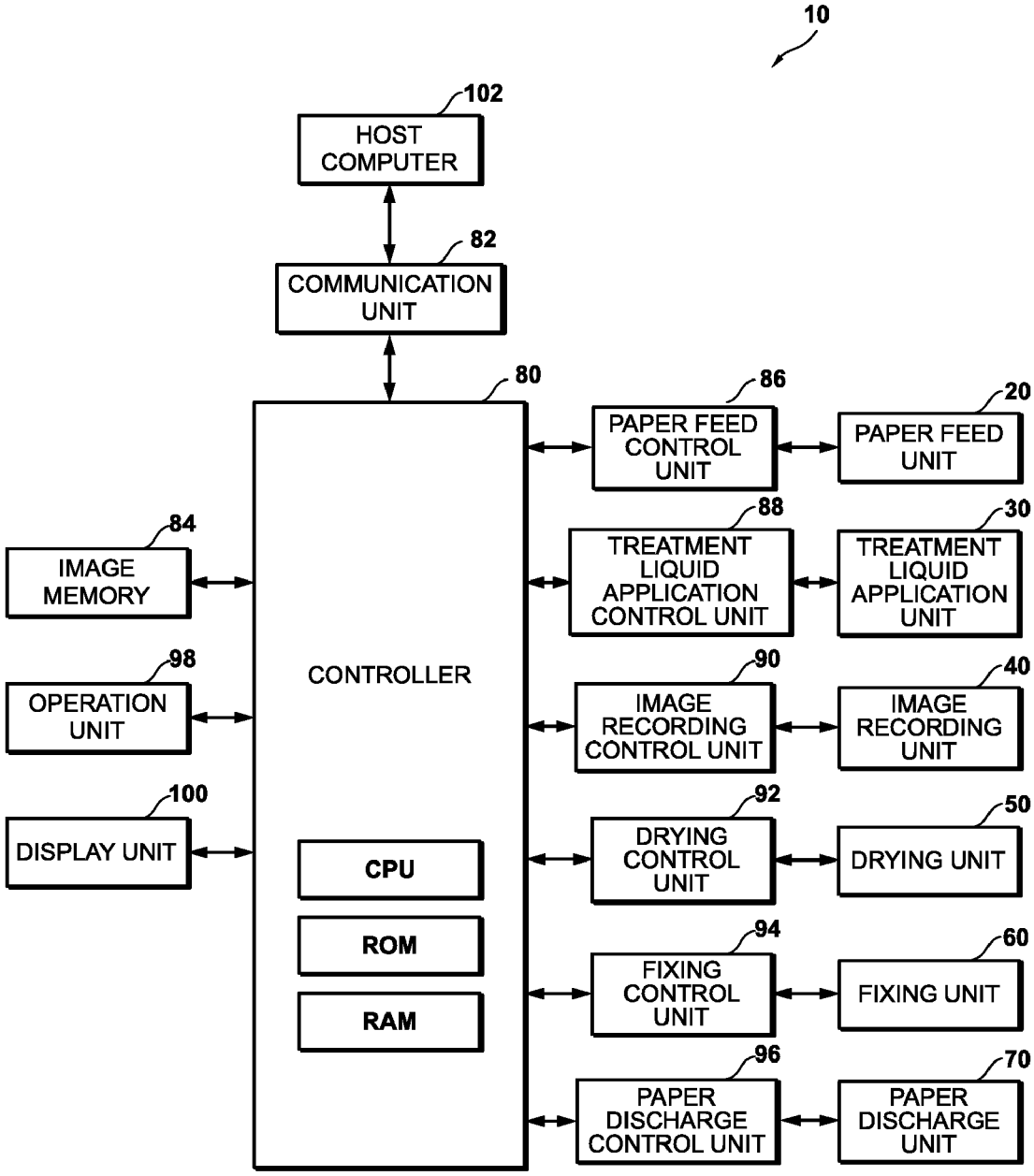
FIG. 2 is a block-diagram illustrating a schematic configuration of a control system of the ink jet recording apparatus.

FIG. 2 is a block diagram showing a schematic configuration of the control system of the ink jet recording apparatus 10 of the resent embodiment.

As shown in the figure, the ink jet recording apparatus 10 includes a controller 80, a communication unit 82, an image memory 84, a paper feed control unit 86, a treatment liquid application control unit 88, an image recording control unit 90, a drying control unit 92, a fixing control unit 94, a paper discharge control unit 96, an operation unit 98, and a display unit 100, and the like.

The controller 80 functions as a control device which controls various units of the ink jet recording apparatus 10 and also functions as a calculation device which conducts a variety of calculation operations. The controller 80 includes a CPU, a ROM, a RAM, and the like and operates according to predetermined control programs. The ROM stores control programs that are executed by the controller 80 and various data necessary for the control.

The communication unit 82 includes a required communication interface and exchanges (sends and receives) data with a host computer 102 connected to the communication interface.

The image memory 84 functions as a temporary storage device for various data including image data, and reading and writing the data are conducted via the controller 80. The image data received from the host computer 102 via the communication unit 82 are stored in the image memory 84.

The paper feed control unit 86 controls the drive of various units constituting the paper feed unit 20 in response to a command from the controller 80.

The treatment liquid application control unit 88 controls the drive of various units constituting the treatment liquid application unit 30 in response to a command from the controller 80.

The image recording control unit 90 controls the drive of various units constituting the image recording unit 40 in response to a command from the controller 80.

The drying control unit 92 controls the drive of various units constituting the drying unit 50 in response to a command from the controller 80.

The fixing control unit 94 controls the drive of various units constituting the fixing unit 60 in response to a command from the controller 80.

The paper discharge control unit 96 controls the drive of various units constituting the paper discharge unit 70 in response to a command from the controller 80.

The operation unit 98 has a required operation device (for example, operation buttons, keyboards, and touch panel, and the like) and outputs the operation information inputted by means of the operation device, to the controller 80. The controller 80 executes processing of various kinds in response to the operation information inputted from the operation unit 98.

The display unit 100 includes a required display device (for example, a LCD panel) and displays required information on the display device in accordance with a command from the controller 80.

As described hereinabove, image data recorded on the paper 14 are sent from the host computer 102 to the ink jet recording apparatus 10 via the communication unit 82 and stored in the image memory 84. The controller 80 conducts a required signal processing of the image data stored in the image memory 84 so as to generate dot data, and controls the drive of each ink head of the image recording unit 40 according to the generated dot data, thereby recording the image represented by the image data on the paper 14.

The dot data are generally generated by conducting color conversion processing and half-tone processing of the image data. In the color conversion processing, image data (for example, RGB 8-bit image data) represented by sRGB or the like are converted into color data (in the present example, KCMYRGB color data) of each color of the ink used in the ink jet recording apparatus 10. In the half-tone processing, the color data of each color generated by the color conversion processing are converted into dot data (in the present example, KCMY RGB dot data) of each color by a processing such as error diffusion.

The controller 80 generates dot data of each color of CMYKRGB by conducting the color conversion processing and half-tone processing with respect to the image data. The image represented by the image data is recorded on the paper 14 by controlling the drive of corresponding ink heads according to the generated dot data of each color.

Image Recording Operation

An image recording operation performed by the ink jet recording apparatus 10 of the present embodiment will be explained below.

The sheets of paper 14 are fed sheet by sheet at a constant paper feed speed from the paper feed device 22 to the paper feed tray 24. The paper 14 that has been fed to the paper feed tray 24 is conveyed in the following sequence: from the transfer drum 32, treatment liquid application drum 34, transfer drum 42, image recording drum 44, transfer drum 52, drying drum 54, transfer drum 62, fixing drum 64, conveyor 74 and then discharged to the stacker 72 (i.e. transfer drum 32→treatment liquid application drum 34→transfer drum 42→image recording drum 44→transfer drum 52→drying drum 54→transfer drum 62→fixing drum 64→conveyor 74→stacker 72). In the conveying process, the paper is subjected to the following processing operations: application of treatment liquid and drying, image recording, drying and fixing (i.e. application of treatment liquid and drying→image recording→drying→fixing), and thereby an image is recorded on the image recording surface. In this conveying process, the conveying drums are rotated synchronously, and the paper 14 is sequentially conveyed while the operations of receiving and transferring the paper 14 are repeated.

The paper 14 that has been fed from the paper feed device 22 to the paper feed tray 24 is transferred to the treatment liquid application drum 34 via the transfer drum 32.

In the conveying process of the paper 14 transferred to the treatment liquid application drum 34, first, the treatment liquid is applied to the image recording surface by the treatment liquid application device 36. The paper 14 to which the treatment liquid has been applied is then heated by the treatment liquid drying device 38. As a result, the solvent component of the treatment liquid applied to the image recording surface is evaporated and dried. The paper 14 in which the treatment liquid has been dried is transferred from the treatment liquid application drum 34 to the transfer drum 42 and then transferred from the transfer drum 42 to the image recording drum 44.

In the conveying process of the paper 14 transferred to the image recording drum 44, first, the cooling air spouted out from the cooling device 110 falls on the image recording surface and cools the image recording surface. The paper 14 is then pressed against the outer circumferential surface of the image recording drum 44 and brought into intimate contact with the circumferential surface of the image recording drum 44 by the pressure roller 130. Then, inks of C, M, Y, and K colors are jetted out from the ink jet heads 46C, 46M, 46Y, and 46K onto the image recording surface, and a color image is recorded on the image recording surface. The paper 14 on which the image has been recorded is transferred from the image recording drum 44 to the transfer drum 52 and then transferred from the transfer drum 52 to the drying drum 54.

The paper 14 transferred to the drying drum 54 is heated by the drying device 56 in the conveying process thereof. As a result, the solvent component contained in the inks applied to the image recording surface is evaporated and dried. After the drying, the paper 14 is transferred from the drying drum 54 to the transfer drum 62 and then transferred from the transfer drum 62 to the fixing drum 64.

The paper 14 transferred to the fixing drum 64 is heated and pressurized in the conveying process thereof by the heat roller 66. As a result, the inks form a film and cockle is corrected. The paper 14 heated and pressurized by the heat roller 66 is transferred from the fixing drum 64 to the conveyor 74, conveyed by the conveyor 74 to the stacker 72, and discharged into the stacker 72.

By the above-described sequence of operations, the processing of recording an image on one sheet of paper 14 is completed. The paper 14 is continuously fed from the paper feed device 22 and image recording is continuously performed on the continuously fed paper 14 by conducting the operations of applying and drying the treatment liquid, image recording, drying and fixing (i.e. processing of applying and drying the treatment liquid→image recording→drying→fixing).

Detailed Description of Configuration of Image Recording Unit

Figure 3:
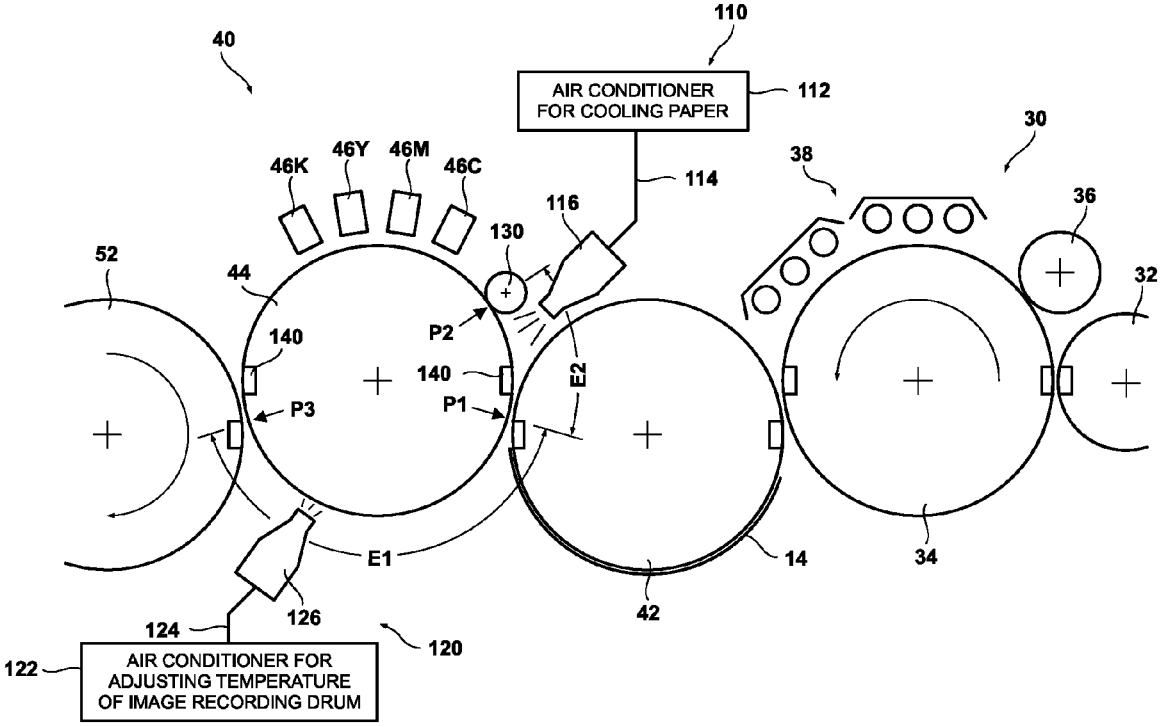
FIG. 3 shows the configuration of an image recording unit.

As described above, the image recording unit 40 includes the image recording drum 44 that conveys the paper 14, ink jet heads 46C, 46M, 46Y, and 46K that jet out ink droplets of C, M, Y, and K colors onto the paper 14, the cooling device 110 that cools the paper 14, the image recording drum temperature adjustment device 120 that adjusts the temperature of the image recording drum 44, and the pressure roller 130 that presses the paper 14 against the outer circumferential surface of the image recording drum 44 and thereby brings the paper into intimate contact with the outer circumferential surface of the image recording drum 44 (see FIG. 3).

Figure 4:
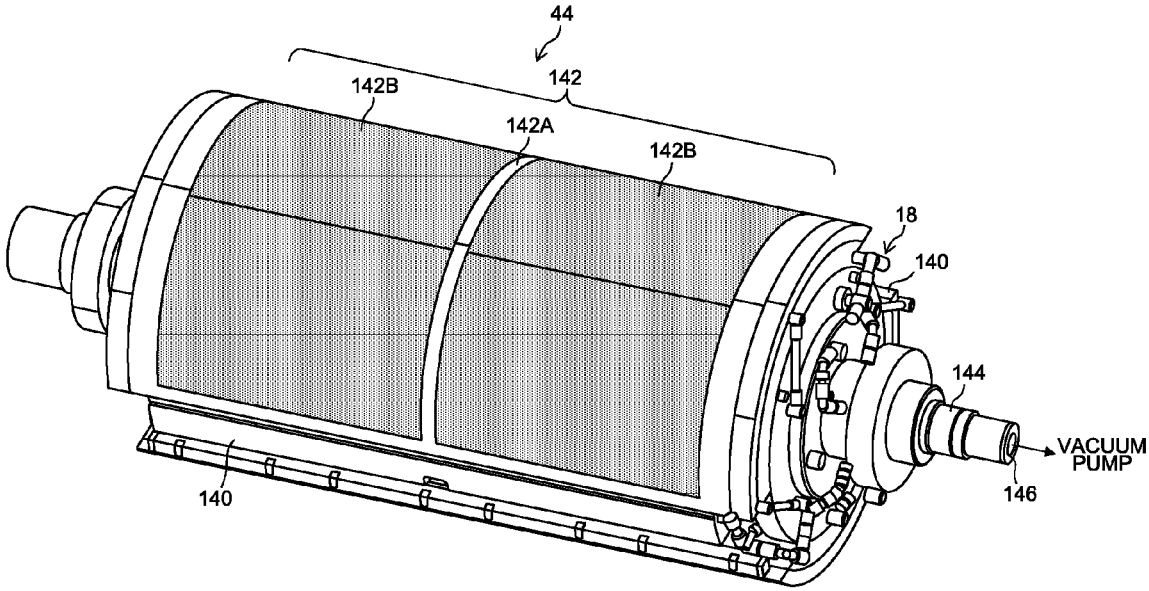
FIG. 4 is a perspective view illustrating the configuration of an image recording drum.

FIG. 4 is a perspective view illustrating the configuration of the image recording drum 44. As shown in the figure, the image recording drum 44 includes grippers 140 in two locations on the outer circumferential surface. The distal end of the paper 14 is gripped by the gripper 140 and the paper is held on the outer circumferential surface (the distal end is held by any one gripper 140). The grippers 140 in two locations are disposed with a spacing of 180 degrees, and a suction and holding region 142 for the paper 14 is formed therebetween.

The suction and holding region 142 is formed according to the paper sheet width, and a non-suction region 142A is formed along the circumferential direction in the center in the widthwise direction of the region. A large number of suction holes are formed according to a predetermined pattern in regions 142B (the regions formed at both sides of the non-suction region 142A: suction regions) of the suction and holding region 142 that are outside the non-suction region 142A. The paper 14 is suctioned to and held on the outer circumferential surface of the image recording drum 44 by being suctioned from the suction holes formed in the suction regions 142B.

A vacuum flow path (not shown in the figure) that communicates with the suction holes formed in the suction regions 142B is provided inside the image recording drum 44. The vacuum flow path is connected with a vacuum pump connection port 146 that is formed in a rotation shaft 144 of the image recording drum 44. A vacuum pump (not shown in the figure) is connected via a pipe (not shown in the figure) to the vacuum pump connection port 146, and when the vacuum pump is actuated, the air is sucked in from the suction holes formed in the suction regions 142B. As a result, the paper 14 wound about the outer circumferential surface of the image recording drum 44 is suctioned to and held on the outer circumferential surface of the image recording drum 44.

Figure 5:
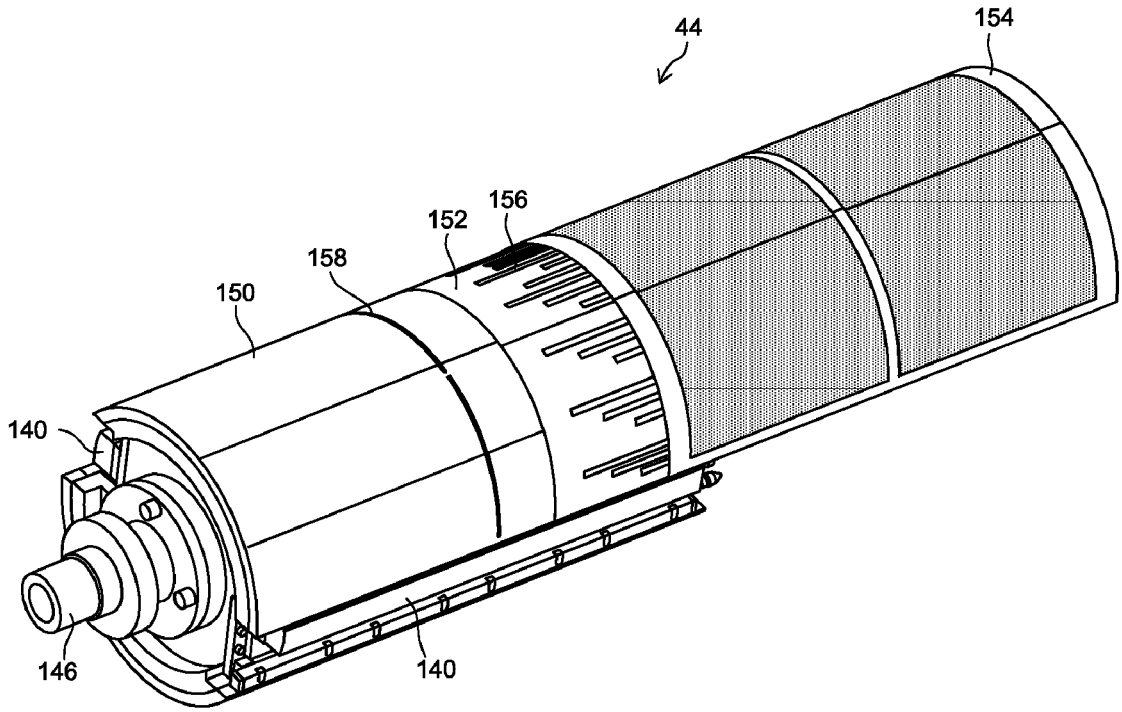
FIG. 5 is an exploded perspective view illustrating the internal structure of the image recording drum.

FIG. 5 is an exploded perspective view illustrating the internal structure of the image recording drum 44. As shown in the figure, the image recording drum 44 includes a main drum body 150 formed in a cylindrical shape, an intermediate sheet 152 that covers the outer periphery of the main drum body 150, and a suction sheet 154 that covers the outer periphery of the intermediate sheet 152 (for example, a diameter of 450 mm).

The suction sheet 154 constitutes the outer circumferential surface of the image recording drum 44, and a large number of suction holes are formed according to a predetermined pattern in the circumferential surface of the suction sheet.

A plurality of suction grooves 156 communicating with the suction holes formed in the suction sheet 154 are formed according to a predetermined arrangement pattern in the intermediate sheet 152.

A drum suction groove 158 communicating with the suction grooves 156 formed in the intermediate sheet 152 is formed in the center (in the widthwise direction) of the main drum body 150. The drum suction groove 158 communicates with the vacuum flow path formed inside the main drum body 150.

When the vacuum pump is actuated, the air is sucked in from each of the suction holes via the vacuum flow path, the drum suction groove 158 and suction grooves 156.

In the image recording drum 44 of the above-described configuration, the suction sheet 154 constituting the outer circumferential surface thereof is composed of a metal with high thermal conductivity (for example, stainless steel or aluminum) and constituted such that the temperature thereof can be easily adjusted.

The image recording drum temperature adjustment device 120 blows temperature adjusting air onto the outer circumferential surface of the image recording drum 44 and adjusts the temperature of the image recording drum 44. The temperature adjusting air blown onto the outer circumferential surface of the image recording drum 44 is supplied from an air conditioner 122 for adjusting the temperature of the image recording drum. The temperature adjusting air supplied from the air conditioner 122 for adjusting the temperature of the image recording drum is sent to a temperature adjusting air jet-out nozzle 126 via a duct 124 and spouted out from the temperature adjusting air jet-out nozzle 126 towards the outer circumferential surface of the image recording drum 44.

The temperature adjusting air jet-out nozzle 126 is formed according to the width of the image recording drum 44 and has a spout port with a width corresponding to the width of the image recording drum 44. The spout port is formed in the form of a slit, and the velocity of the temperature adjusting air sent via the duct 124 is increased and the air is spouted out as a jet.

As described hereinabove, the temperature adjusting air jet-out nozzle 126 is disposed in a region outside the conveying path of the paper 14 and the temperature adjusting air that has been spouted out falls at all times on the outer circumferential surface of the image recording drum 44.

In the image recording drum 44 of the present embodiment, the paper 14 is transferred from the transfer drum 42 of the previous stage to the image recording drum 44 in a predetermined transfer position P1, rotationally conveyed in the counterclockwise direction (as shown in the figure) and transferred to the transfer drum 52 of the subsequent stage in a predetermined transfer position P3. Therefore, the temperature adjusting air jet-out nozzle 126 is disposed in a region E1 from the position P3 to the position P1 along the rotation direction of the image recording drum 44. As a result, the temperature adjusting air can be blown onto the image recording drum 44 at all times, without falling on the paper 14.

A temperature sensor (not shown in the figure) is provided in the image recording drum 44, and information representing the detection results thereof is outputted to the controller 80. The controller 80 controls the operations (flow temperature, flow amount, etc.) of the air conditioner 122 for adjusting the temperature of the image recording drum on the basis of the detection results of the temperature sensor.

The pressure roller 130 is formed according to the paper width. The outer circumferential surface of the pressure roller 130 is covered with a rubber (for example, NBR) and pressed against and brought into contact with the outer circumferential surface of the image recording drum 44. The pressure roller 130 applies a pressure to the image recording surface of the paper 14 transferred to the image recording drum 44, whereby the paper is pressed against the outer circumferential surface of the image recording drum 44 and brought into intimate contact with the outer circumferential surface of the image recording drum 44.

The pressure roller 130 is provided in a position P2 (position obtained by rotation through a predetermined rotation angle from P1 in the conveying direction of the paper 14) that is close to the transfer position P1 in which the transfer drum 42 transfers the paper 14 to the image recording drum 44.

The cooling device 110 blows cooling air onto the outer circumferential surface of the paper 14 conveyed by the image recording drum 44 and cools the paper 14. The cooling air blown onto the paper 14 is supplied from an air conditioner 112 for cooling the paper. The cooling air supplied from the air conditioner 112 for cooling the paper is sent to a cooling air jet-out nozzle 116 via a duct 114 and spouted out from the cooling air jet-out nozzle 116 towards the outer circumferential surface of the image recording drum 44.

The cooling air jet-out nozzle 116 is formed according to the width of the image recording drum 44 and has a spout port with a width corresponding to the width of the image recording drum 44. The spout port is formed in the form of a slit, and the velocity of the cooling air sent via the duct 114 is increased and the air is spouted out as a jet.

As described hereinabove, the cooling air jet-out nozzle 116 is disposed so that the cooling air is spouted out onto the region E2 between the transfer position P1 of the paper 14 and the installation position P2 of the pressure roller 130. By using such a configuration in which the cooling air is spouted out onto a region between the transfer position P1 of the paper 14 and the installation position P2 of the pressure roller 130, it is possible to prevent the cooling air from leaking and cool the paper 14 with good efficiency. Thus, by spouting out the cooling air into a space closed from the front side and rear side by the pressure roller 130 and the transfer drum 42, it is possible to retain the cooling air in this closed space and cool the paper 14 with good efficiency. Further, the image recording drum 44 can be also cooled by using this cooling air.

The operation (flow temperature, flow amount, etc.) of the air conditioner 112 for cooling the paper is controlled by the controller 80, and the controller 80 controls the operation of the air conditioner 112 for cooling the paper according to the temperature of the image recording drum 44. In the present example, the air flow temperature is controlled according to the temperature of the image recording drum 44. In this case, for example, a target temperature is set (for example, at 25° C.), and when the temperature of the image recording drum 44 exceeds the target temperature that has been set in advance, the temperature of the cooling air that is blown is set to a minimum temperature that can be set (for example, when the minimum temperature that can be set is 18° C., the temperature of the cooling air is set to 18° C.). When the temperature of the image recording drum 44 is equal to or lower than the target temperature, the temperature of the cooling air that is blown is made equal to the temperature of the image recording drum 44.

Detailed Description of Operation of Image Recording Unit

As described hereinabove, the paper 14 which has the image recording surface having received the treatment liquid and heated/dried in the treatment liquid application unit 30, is transferred to the image recording drum 44. The paper 14 is transferred from the transfer drum 42 in the predetermined transfer position.

The paper 14 transferred from the transfer drum 42 to the image recording drum 44 is conveyed by the image recording drum 44 at a constant speed (for example, 535 mm/s) along a predetermined conveying path. The cooling air spouted out from the cooling device 110 falls on the image recording surface and the image recording surface is cooled. The paper is then pressed against the image recording drum 44 by the pressure roller 130 and brought into intimate contact with the outer circumferential surface of the image recording drum 44.

As described above, a large number of suction holes are formed in the outer circumferential surface of the image recording drum 44 and the air is sucked in form the suction holes. As a result, the paper 14 that has been pressed against the outer circumferential surface by the pressure roller 130 is sucked in by the suction holes and brought into intimate contact with the outer circumferential surface.

Further, since the temperature of the image recording drum 44 is adjusted by the image recording drum temperature adjustment device 120, the contact surface of the paper 14 is cooled by the contact with the outer circumferential surface of the image recording drum 44 (when the image recording drum 44 is cooled).

Thus, the paper 14 is cooled from the front and rear surfaces and conveyed in such a cooled state to the zone where the ink jet heads 46C, 46M, 46Y, and 46K are disposed. Then, inks are jetted out from the ink jet heads 46C, 46M, 46Y, and 46K onto the image recording surface. As a result, a color image is recorded on the image recording surface.

The paper 14 on which the image has been recorded is then transferred from the image recording drum 44 to the transfer drum 52, conveyed along the predetermined conveying path by the transfer drum 52, and transferred to the conveying drum 54 of the drying unit 50.

Thus, in the ink jet recording apparatus 10 of the present embodiment, the paper 14 is cooled before the paper 14 is conveyed to the zone where the ink jet heads 46C, 46M, 46Y, and 46K are disposed, the cooled paper 14 is conveyed to the zone where the ink jet heads 46C, 46M, 46Y, and 46K are disposed, and image recording is performed. Therefore, dew condensation can be induced on the paper 14 and the occurrence of dew condensation on the equipment can be prevented. Thus, dew condensation occurs when moisture contained in the atmosphere exceeds the absolute moisture amount and occurs on members with a low surface temperature that are in contact with the atmosphere. Therefore, by cooling the paper 14, it is possible to induce dew condensation on the paper 14. As a result, the occurrence of dew condensation on the equipment can be prevented. In particular in the ink jet recording apparatus 10 of the present embodiment, the ink jet heads 46C, 46M, 46Y, and 46K are controlled to a temperature equal to or lower than a predetermined temperature in order to stabilize the meniscus. Therefore, by cooling the paper 14 and inducing dew condensation on the paper 14, it is possible to prevent effectively the dew condensation on the ink jet heads 46C, 46M, 46Y, and 46K. As a result, a high-quality image can be recorded with good stability.

Further, since a configuration is used such that the cooling is conducted not only by the image recording drum 44 but also by blowing the cooling air directly onto the paper 14, the paper can be cooled instantly. As a result, it is not necessary to reduce the conveying speed and the printing speed can be increased. Further, since it is not necessary to extend the conveying path, the apparatus can be made more compact.

OTHER EMBODIMENTS

Other Embodiment 1

In the ink jet recording apparatus 10 of the above-described embodiment, a configuration is used in which the cooling air that has been cooled to a predetermined temperature by the air conditioner 112 for cooling the paper 14 is blown onto the paper and the paper 14 is cooled. In this case, it is preferred that dehumidified cooling air be blown. As a result, the occurrence of dew condensation can be prevented even more effectively.

Therefore, it is preferred that the air conditioner 112 for cooling the paper be provided with a dehumidification function (dehumidification means).

Likewise, the temperature adjusting air that is blown onto the image recording drum 44 to adjust the temperature of the image recording drum 44 is also preferred to be dehumidified. Therefore, it is also preferred that the air conditioner 122 for adjusting the temperature of the image recording drum be provided with a dehumidification function (dehumidification means).

Other Embodiment 2

In the above-described embodiment, a configuration is used in which the temperature of the cooling air blown from the air conditioner 112 for cooling the paper is controlled according to the temperature of the image recording drum 44, but it is also possible to control the amount (rate) of the cooling air blown from the air conditioner 112 for cooling the paper according to the temperature of the image recording drum 44. In this case, for example, when the temperature of the image recording drum 44 exceeds a target temperature (for example, 25° C.) that has been set in advance, the amount of the blown cooling air is increased (i.e. large amount of cooling air is preferred), and when the temperature of the image recording drum is equal to or lower than the target temperature, the amount of the blown cooling air is decreased (i.e. small amount of cooling air is preferred). Thus, a configuration is used in which the amount of air can be set to two stages, namely, large and small, and switching of the air amount between the two stages is conducted according to the temperature of the image recording drum 44.

A configuration may be also used in which both the temperature and the amount of the cooling air blown from the air conditioner 112 for cooling the paper are controlled according to the temperature of the image recording drum 44. In this case, for example, when the temperature of the image recording drum 44 exceeds a target temperature (for example, 25° C.) that has been set in advance, the amount of the blown cooling air is increased and the temperature thereof is minimized, and when the temperature of the image recording drum is equal to or lower than the target temperature, the amount of the blown cooling air is decreased and the temperature thereof is made equal to the temperature of the image recording drum 44.

It is also possible to blow the cooling air at the same temperature and in a constant amount, without controlling the temperature and amount of the cooling air.

Further, the temperature control of the cooling air may be conducted manually by the operator, rather than automatically. Thus, a configuration may be used such that the temperature and amount of the cooling air blown from the air conditioner 112 for cooling the paper can be adjusted manually and the cooling air is blown at the temperature and in the amount that are set by the operator.

The same is applicable to the air conditioner 122 for adjusting the temperature of the image recording drum

Other Embodiment 3

Ease of cooling the paper 14 differs depending on the paper size (thickness, dimensions). In particular, ease of cooling changes depending on the paper thickness, and a thicker paper is more difficult to cool.

Accordingly, it is preferred that the temperature and/or amount of the cooling air blown from the air conditioner 112 for cooling the paper be controlled according to the size of the paper 14.

For example, the thickness of the paper 14 is classified in a stage-like manner, and the temperature and amount are controlled according to the thickness. For example, the thickness of the paper 14 is classified into the following three stages: (1) equal to or less than 100 gsm, (2) 101 to 200 gsm, and (3) 201 to 300 gsm. When the paper 14 used has a thickness of equal to or less than 100 gsm, the cooling air is blown at a cooling air temperature of 25° C. and a small amount of the cooling air. When the paper 14 used has a thickness of 101 to 200 gsm, the cooling air is blown at a cooling air temperature of 18° C. and a small amount of the cooling air (or a cooling air temperature of 25° C. and a large amount of the cooling air). When the paper 14 used has a thickness of 201 to 300 gsm, the cooling air is blown at a cooling air temperature of 18° C. and a large amount of the cooling air (a case in which the air amount of the air conditioner 112 for cooling the paper is set to two stages, namely, large and small). As a result, the paper 14 can be cooled more adequately.

In this case, the controller 80 that controls the air conditioner 112 for cooling the paper acquires size information of the paper 14 used (inputted manually by the operator or detected automatically) and automatically controls the temperature and amount of air.

Further, the temperature and amount of air of the air conditioner 112 for cooling the paper may be also set manually by the operator according to the size of the paper 14 used.

Other Embodiment 4

In the above-described embodiment, a configuration is used in which the cooling air is spouted out by the cooling device 110 at all times to cool the paper 14, but the cooling device can be desirably operated in conjunction with the operation of the image recording drum temperature adjusting device 120.

Thus, a configuration is used such that when the image recording drum temperature adjusting device 120 conducts the heating control of the image recording drum 44, the blowing of the cooling air is stopped (paper cooling is OFF), and only when the image recording drum temperature adjusting device 120 conducts the cooling control of the image recording drum 44, the cooling air is spouted out (paper cooling is ON). As a result, unnecessary cooling can be prevented and the apparatus can be operated with good efficiency.

Further, for example, the operation may be controlled according to the temperature of the image recording drum 44. For example, a configuration may be used such that when the temperature of the image recording drum 44 is equal to or lower than a set temperature (for example, 25° C.), the blowing of the cooling air is stopped (paper cooling is OFF), and once the temperature of the image recording drum 44 exceeds the set temperature, the cooling air is spouted out (paper cooling is ON).

This adjustment may be conducted automatically by the controller 80 or manually by the operator.

Other Embodiment 5

It is preferred that the cooling device 110 include an ionizer and be configured so that the spouted-out cooling flow has ionized molecules in the air. As a result, static electricity of the paper 14 can be removed, the paper 14 can be prevented from sticking to the image recording drum 44 under the effect of static electricity, and variations in the ink flight caused by static electricity can be prevented.

The ionizer may be incorporated in the air conditioner 112 for cooling the paper or may be disposed in the duct 114.

Other Embodiment 6

In the configuration of the above-described embodiment, the temperature of the image recording drum 44 is adjusted by blowing the temperature-adjusting air onto the image recording drum 44, but such a configuration for adjusting the temperature of the image recording drum 44 is not limiting. Thus, a temperature adjusting device (a heater, a Peltier element, or the like) can be incorporated in the image recording drum 44 and the temperature of the image recording drum 44 can be adjusted with this temperature adjusting device.

Other Embodiment 7

In the above-described embodiments, the case is explained in which the present invention is applied to an ink jet recording apparatus, but such an application of the present invention is not limiting and the present invention can be similarly applied to image recording apparatuses using other image recording systems such as screen printing.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus comprising:

an image recording drum that suctions and holds a paper on an outer circumferential surface thereof in state of an image recording surface of the paper facing outward, and rotates at a constant speed so as to convey the paper;

an image recording drum temperature adjustment device which adjusts temperature of the image recording drum;

a cooling device which spouts out cooling air from a constant position towards the outer circumferential surface of the image recording drum in such a manner that the cooling air is blown onto the image recording surface of the paper conveyed by the image recording drum so as to cool the paper; and an image recording device which deposits ink onto the image recording surface of the paper conveyed by the image recording drum to record an image on the image recording surface, the image recording device being situated in a stage after the cooling device and depositing the ink onto the paper having been cooled to record the image.

2. The image recording apparatus as defined in claim 1, further comprising a treatment liquid application unit that deposits a predetermined treatment liquid onto the image recording surface of the paper and dries the treatment liquid deposited onto the image recording surface, wherein the paper which the treatment liquid is deposited onto and is dried by the treatment liquid application unit is fed to the image recording drum.

3. The image recording apparatus as defined in claim 2, wherein:

the treatment liquid application unit includes:

a treatment liquid application drum that holds the paper on the outer circumferential surface thereof in state of the image recording surface of the paper facing outward, and rotates at a constant speed so as to convey the paper;

a transfer drum that is disposed between the treatment liquid application drum and the image recording drum, receives the paper from the treatment liquid application drum, rotates at a constant speed so as to convey the paper, and transfers the paper to the image recording drum in a predetermined transfer position;

a treatment liquid application device which deposits the treatment liquid onto the image recording surface of the paper conveyed by the treatment liquid application drum; and a drying device which heats the paper to which the treatment liquid has been applied by the treatment liquid application device, so as to dry the treatment liquid, a paper pressure roller formed according to width of the image recording drum is installed in close to a position where the paper is transferred from the transfer drum to the image recording drum, while being in contact with the outer circumferential surface of the image recording drum in such a manner that the paper pressure roller presses the paper transferred from the transfer drum against the outer circumferential surface of the image recording drum so as to bring the paper into intimate contact with the outer circumferential surface, and the cooling device spouts out the cooling air toward between the position where the paper is transferred from the transfer drum to the image recording drum and a position where the paper pressure roller is installed.

4. The image recording apparatus as defined in claim 2, wherein:

the treatment liquid application unit includes a treatment liquid drying device that heats the paper to dry the treatment liquid having been deposited on the image recording surface of the paper; and the cooling device cools the paper having been heated by the treatment liquid drying device.

5. The image recording apparatus as defined in claim 1, further comprising a temperature adjustment device which adjusts temperature of the image recording device.

6. The image recording apparatus as defined in claim 1, wherein the cooling device spouts out the cooling air in form of a jet.

7. The image recording apparatus as defined in claim 1, wherein the cooling device spouts out the dehumidified cooling air.

8. The image recording apparatus as defined in claim 1, further comprising an adjustment device which adjusts temperature and/or an amount of the cooling air spouted out by the cooling device.

9. The image recording apparatus as defined in claim 1, further comprising a control device which controls temperature and/or an amount of the cooling air spouted out by the cooling device according to the temperature of the image recording drum.

10. The image recording apparatus as defined in claim 1, further comprising a control device which controls temperature and/or an amount of the cooling air spouted out by the cooling device according to thickness and/or size of the paper.

11. The image recording apparatus as defined in claim 1, further comprising a drive control device which switches ON/OFF driving of the cooling device, wherein when the image recording drum temperature adjustment device heats the image recording drum, the drive control device switches OFF the driving of the cooling device, and when the image recording drum temperature adjustment device cools the image recording drum, the drive control device switches ON the driving of the cooling device.

12. The image recording apparatus as defined in claim 1, wherein the cooling device has an ionizer.

13. The image recording apparatus as defined in claim 1, wherein the image recording drum temperature adjustment device spouts out a temperature adjusting air towards the outer circumferential surface of the image recording drum, from a position where the paper conveyed by the image recording drum does not pass, in such a manner that the temperature adjusting air is blown onto the outer circumferential surface of the image recording drum so as to adjust the temperature of the image recording drum.

14. The image recording apparatus as defined in claim 1, wherein the image recording device employs an ink jet system to record the image on the paper.

* * * * *